US007494347B1

(12) United States Patent
Wang et al.

(10) Patent No.: US 7,494,347 B1
(45) Date of Patent: Feb. 24, 2009

(54) BOARD-TO-BOARD CONNECTOR

(75) Inventors: Chien Chun Wang, Taoyuan (TW); Tung Chiug Kua, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 12/000,941

(22) Filed: Dec. 19, 2007

(51) Int. Cl.
*H01R 12/00* (2006.01)

(52) U.S. Cl. ..... 439/74; 439/660

(58) Field of Classification Search ..... 439/65, 439/660, 74, 345, 346, 81
See application file for complete search history.

(56) References Cited

U.S. PATENT DOCUMENTS 6,132,258 A * 10/2000 Kajinuma ..... 439/660
6,764,314 B1 * 7/2004 Lee ..... 439/65
6,976,853 B2 * 12/2005 Goto ..... 439/74
7,172,433 B2 * 2/2007 Tsai ..... 439/74
7,172,449 B2 * 2/2007 Shindo et al. ..... 439/341
2006/0052008 A1 * 3/2006 Pan et al. ..... 439/660
2007/0020966 A1 * 1/2007 Lee et al. ..... 439/74

* cited by examiner

*Primary Examiner*—Hien Vu
(74) *Attorney, Agent, or Firm*—Rosenberg, Klein & Lee

(57) ABSTRACT

A board-to-board connector has a first insulative housing and a plurality of first terminals received in the first insulative housing. The first insulative housing defines a plurality of first passageways arrayed in two rows opposing to each other. Positioning portions are formed on the first insulative housing and respectively protrude into the first passageways. Each first terminal includes a base, a first soldering portion extending outwardly from a bottom of a side of the base, and a bifurcate upper contact portion extending upwardly from the base. The upper contact portion has two contact sections, a concave portion being defined between the two contact sections for corresponding to the positioning portion. When the first terminals are inserted into the first insulative housing, the concave portions of the first terminals lock with the positioning portions in the first passageways for assuring reliable engagement of the first terminals to the first insulative housing.

6 Claims, 6 Drawing Sheets

BOARD-TO-BOARD CONNECTOR

BACKGROUND OF THE INVENTION

1. Field of the Invention

The present invention relates to a board-to-board connector, and particularly to a board-to-board connector assembled easily and positioned reliably.

2. Related Art

Nowadays, computers and electronic technology are developing rapidly, and correspondingly, a variety of electronic products are commonly employed. Development of computers and electronic technology has trend of miniature. For decreasing profiles of electronic products, a board-to-board connector with a plurality of terminals therein is put forth. Two circuit boards are overlapped and electrically connect with each other. A board-to-board connector is disposed on one of the circuit boards, and a mating connector is disposed on the other circuit board for mating with the board-to-board connector, thereby electrically connecting the two circuit boards.

A conventional board-to-board connector is disclosed in Taiwan patent application No. 090215541, which includes a male connector and a female connector inserted to each other. The male connector comprises a male housing and male terminals, and the female connector comprises a female housing and female terminals. The male terminals are embedded into male passageways of the male housing from top to bottom. The female terminals are embedded into the female passageways of the female housing from bottom to top. The male housing is put upside down to be inserted onto the female housing, and the male terminals contact and electrically connect with the female terminals.

However, as for the conventional board-to-board connector, the male terminals are assembled in the male passageways in such a way that only the male terminals are plugged into the male passageways without any retention structure. As a result, the male terminals are readily to depart from the male passageways, making contact unreliable. The male terminals are assembled to the male passageways from over the male housing. During assembly, the male passageways in a top of the male housing tend to be damaged by tools, increasing product defective rate.

SUMMARY OF THE INVENTION

An object of the present invention is to provide a board-to-board connector which makes assembly of first terminals thereof more smooth and firm.

Another object of the present invention is to provide a board-to-board connector which have first terminals assembled reliably thereby assuring stable signal transmission.

To achieve the above objects, the board-to-board connector according to the present invention comprises a first connector. The first connector includes a first insulative housing and a plurality of first terminals received in the first insulative housing. The first insulative housing defines a plurality of first passageways arrayed in at least two rows opposing to each other. Positioning portions are formed on the first insulative housing and respectively protrude into the first passageways. Each first terminal includes a base, a first soldering portion extending outwardly from a bottom of a side of the base, and a bifurcate upper contact portion extending upwardly from the base. The base is positioned in the first passageway of the first insulative housing, and the first soldering portion extends out of the first passageway. The upper contact portion is inserted in the first passageway with sides of the upper contact portion extending beyond the first passageway. The upper contact portion has two contact sections, a concave portion being defined between the two contact sections for corresponding to the positioning portion.

According to another aspect, the board-to-board connector according to the present invention comprises a first connector and a second connector matable with the first connector. The first connector comprises a first insulative housing and a plurality of first terminals. The first insulative housing defines a plurality of first passageways arrayed in at least two rows opposing to each other. Positioning portions are formed on the first insulative housing and respectively protrude into the first passageways. Each terminal includes a base positioned in the first passageway of the first insulative housing, a first soldering portion extending from the base, and a bifurcate upper contact portion extending upwardly from the base. The upper contact portion has two contact sections, a concave portion being defined between the two contact sections for corresponding to the positioning portion. The second connector comprises a second insulative housing and a plurality of second terminals. The second insulative housing defines a plurality of second passageways arrayed in at least two rows opposing to each other. Through grooves are defined in the second insulative housing and are arrayed at outward sides of the second passageways. Each second terminal includes a U-shaped lower contact portion embedded in the second passageway, a retaining portion extending from the lower contact portion, and a second soldering portion extending from the retaining portion. Inner surfaces of the lower contact portion substantially extend into the second passageway. The upper contact portion of the first terminal electrically connects with the lower contact portion of the second terminal when the first terminal and the second terminal are assembled together.

DESCRIPTION OF THE PREFERRED EMBODIMENTS

Figure 1:
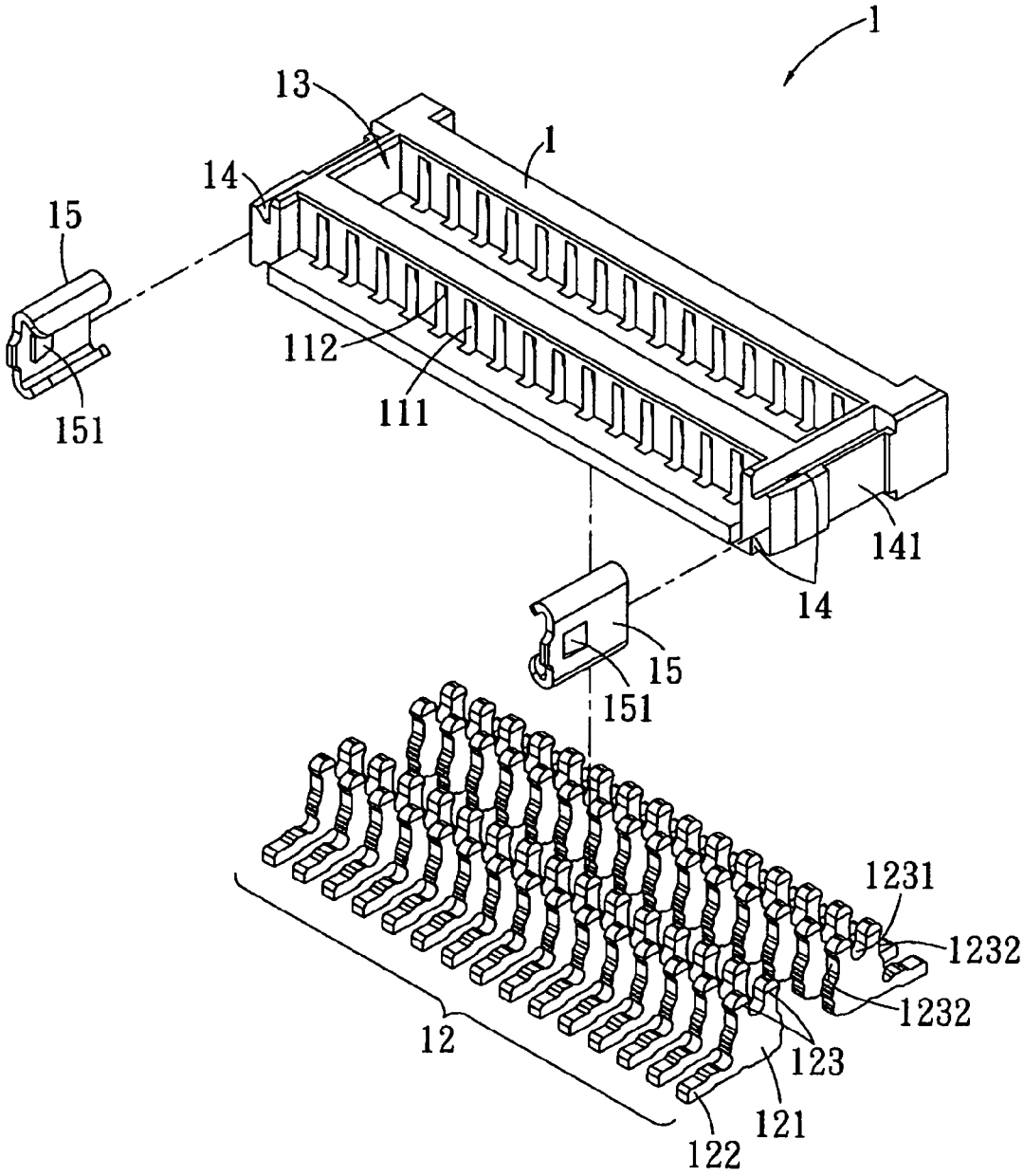
FIG. 1 is an exploded view of a first connector according to the present invention.
Figure 2:
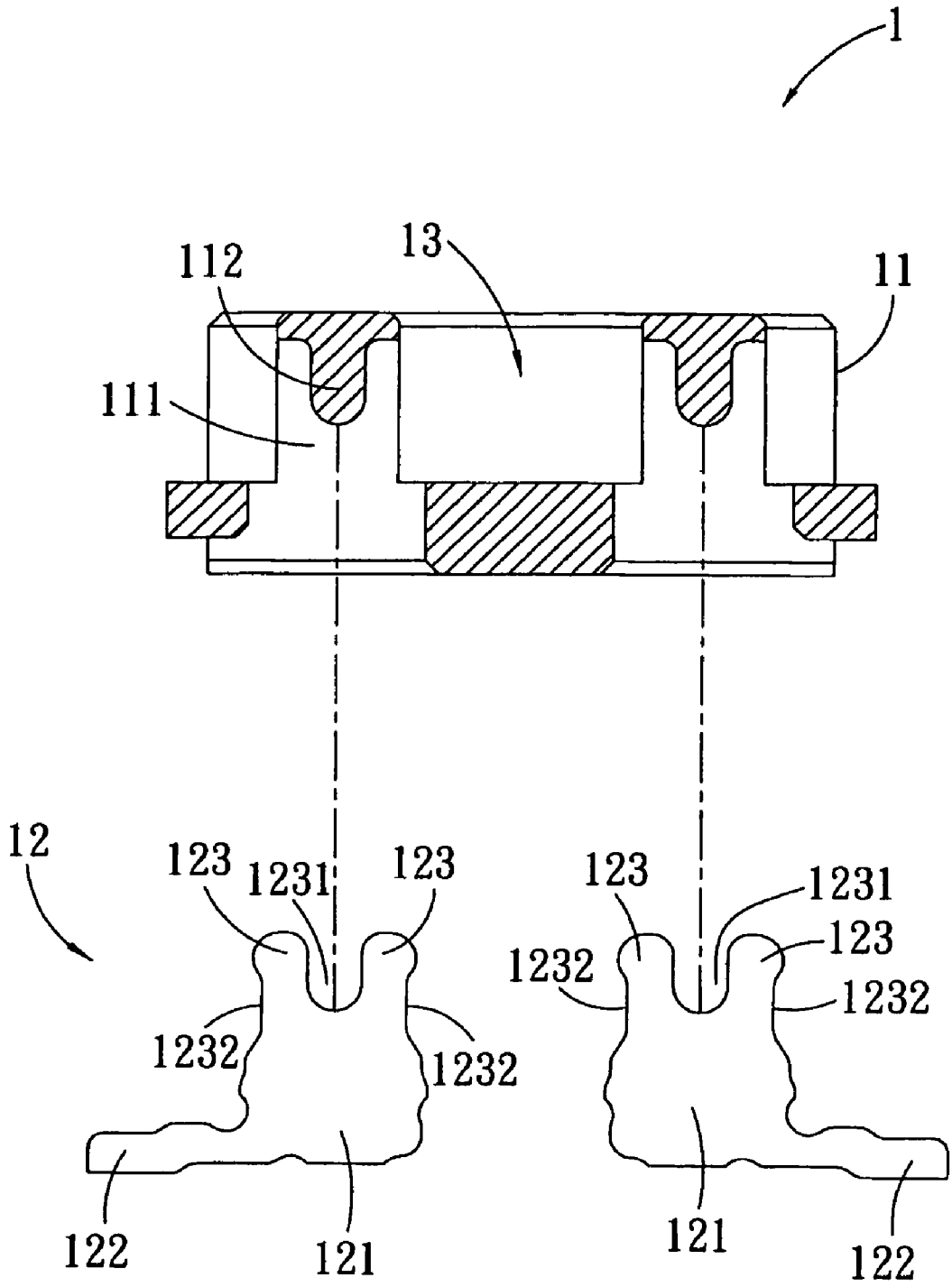
FIG. 2 is a cross-sectional and exploded view of the first connector of FIG. 1.
Figure 3:
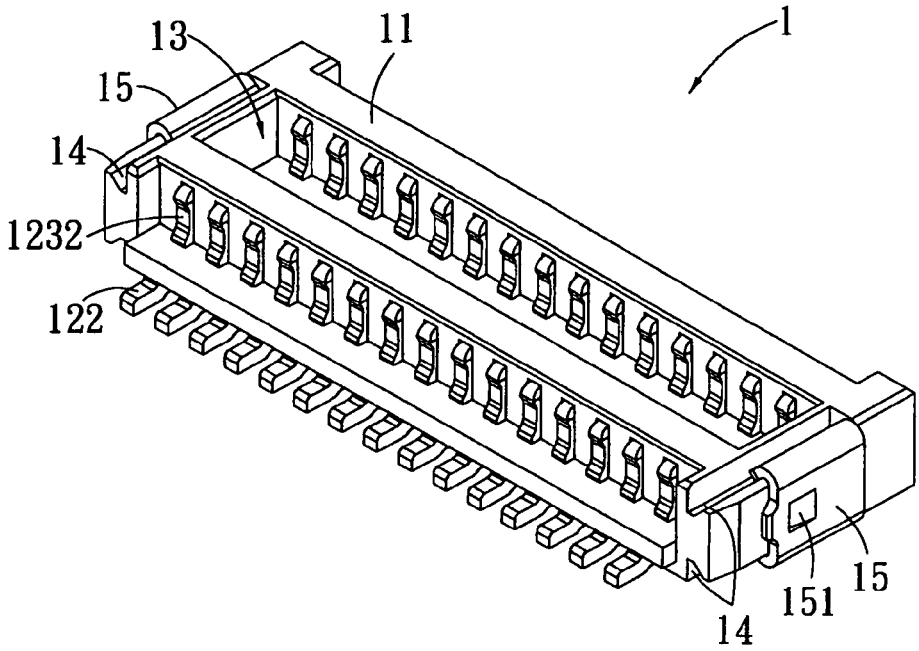
FIG. 3 is a perspective view of the first connector of FIG. 1.
Figure 4:
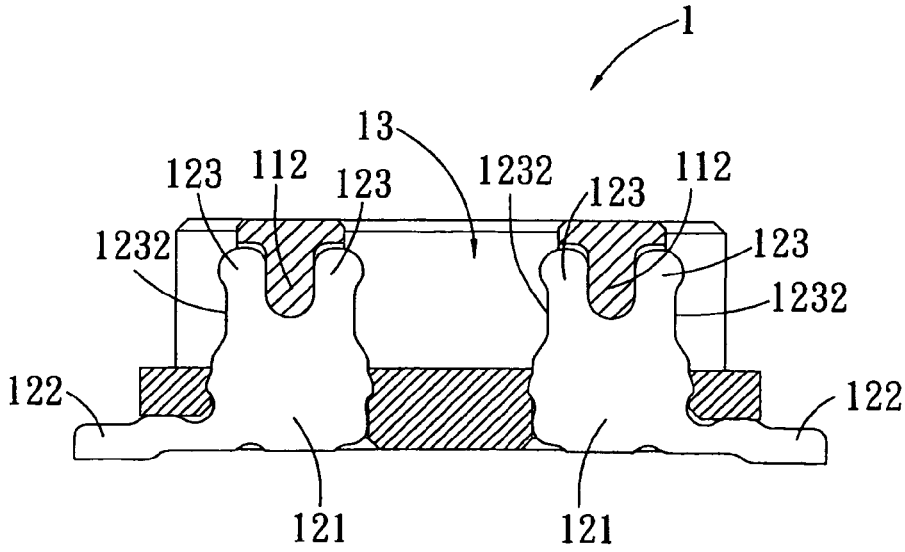
FIG. 4 is a cross-sectional and assembled view of the first connector of FIG. 1.

Referring to FIGS. 1, 2, 3 and 4, a first connector 1 in accordance with the present invention comprises a first insulative housing 11 and a plurality of first terminals 12.

The first insulative housing 11 is substantially rectangular and defines a plurality of first passageways 111 arrayed in two rows opposing to each other. Positioning portions 112 are formed on the first insulative housing 11 and respectively protrude into the first passageways 111. A receiving cavity 13 is provided between the two rows of first passageways 111. First rails 14 are formed on upper and lower edges of opposite end surfaces of the first insulative housing 11. First recesses 141 are respectively defined on the opposite end surfaces of the first insulative housing 11. Each first recess 141 is located between the first rails 14 on an end surface of the first insulative housing 11 and is substantially perpendicular to the first rails 14 on the end surface of the first insulative housing 11. First pads 15 are slidable along the first rails 14 to be assembled onto the opposite ends of the first insulative housing 11. Each first pad 15 forms a first abutting portion 151 for corresponding to the first recess 141 to be positioned. In assembly, the first abutting portions 151 lock with the first recesses 141 for positioning and preventing the first pads 15 from disengagement.

Each first terminal 12 comprises a base 121, a first soldering portion 122 extending outwardly from a bottom of a side of the base 121, and a bifurcate upper contact portion 123 extending upwardly from the base 121. The upper contact portion 123 has two contact sections, and a concave portion 1231 is defined between the two contact sections for corresponding to the positioning portion 112. Contact grooves 1232 are respectively defined on outward sides of upper contact portion 123. During assembly, the first terminal 12 is respectively inserted into the first passageway 111 from below the first insulative housing 11. The base 121 of the first terminal 12 is positioned in a bottom of the first passageway 111. The first soldering portion 122 extends out of the first passageway 111. The upper contact portion 123 is inserted in the first passageway 111 with sides of the upper contact portion 123 extending beyond the first passageway 111 for mating with a mating connector. The concave portion 1231 locks with the positioning portion 112 to be positioned fixedly.

Figure 5:
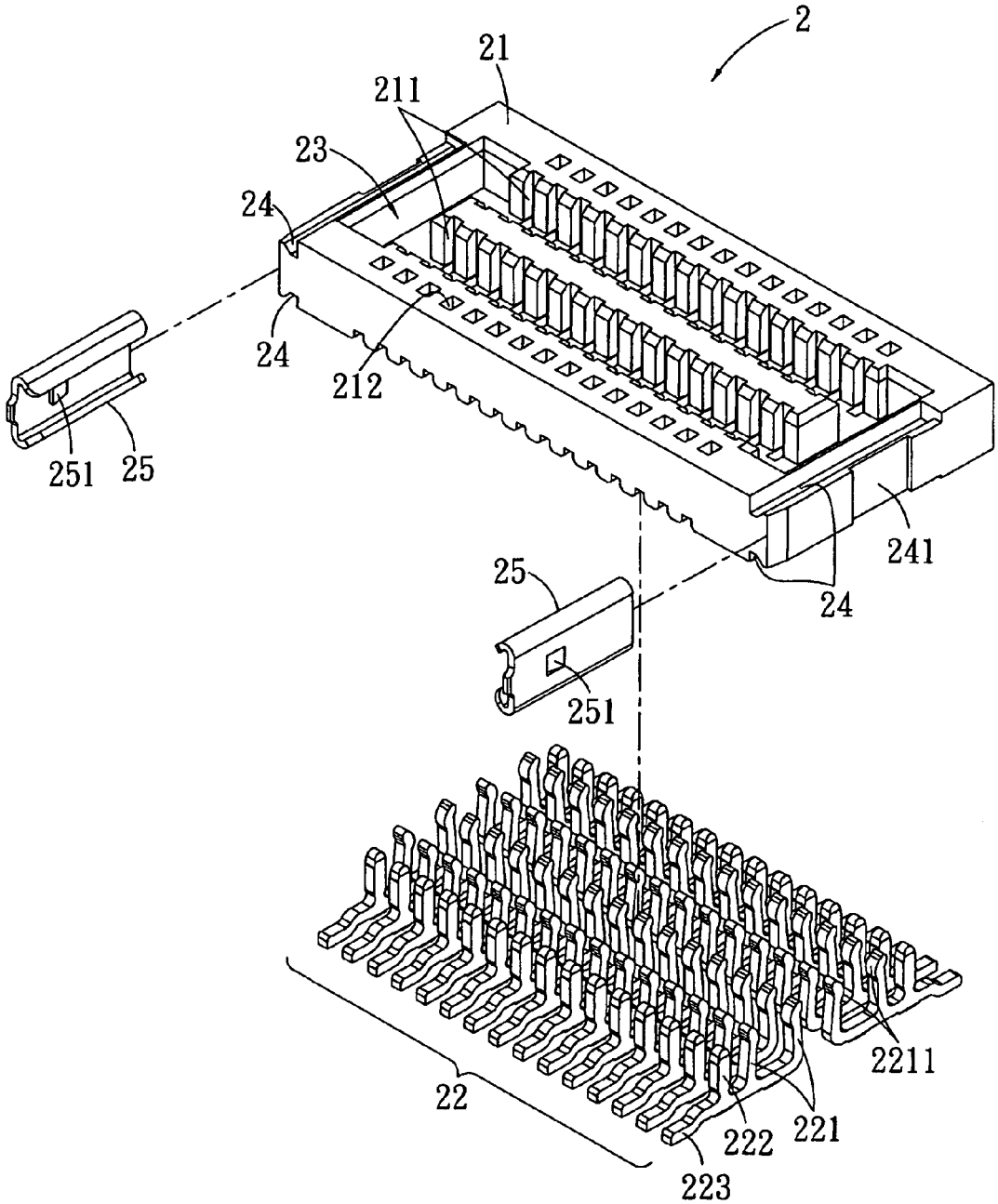
FIG. 5 is an exploded view of a second connector according to the present invention.
Figure 6:
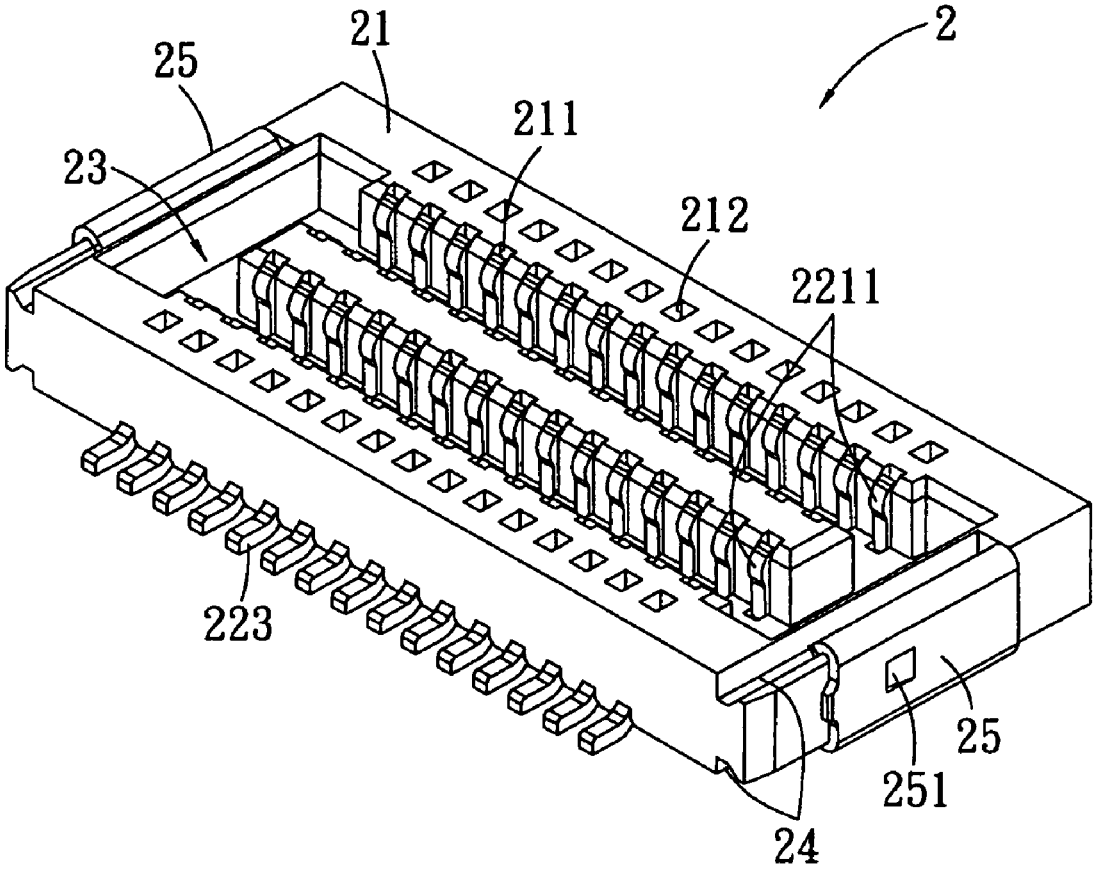
FIG. 6 is an assembled view of the second connector of FIG. 5.

Referring to FIGS. 5 and 6, a second connector 2 in accordance with the present invention comprises a second insulative housing 21 and a plurality of second terminals 22 received in the second insulative housing 21. The second insulative housing 21 is substantially rectangular, and defines second passageways 211 arrayed in two rows opposing to each other. A receiving slot 23 is defined between the two rows of second passageways 211. Through grooves 212 are defined in the second insulative housing 21 from top to bottom and are arrayed at both outward sides of the two rows of second passageways 211. Second rails 24 are formed on upper and lower edges of opposite ends of the second insulative housing 21. Second recesses 241 are respectively defined in the opposite end surfaces of the second insulative housing 21. Each second recess 241 is located between the second rails 24 on an end surface of the second insulative housing 21 and substantially perpendicular to the second rails 24 on the end surface of the second insulative housing 21. Second pads 25 are slidable along the second rails 24 to be assembled onto the opposite ends of the second insulative housing 21. Each second pad 25 forms a second abutting portion 251 for corresponding to the second recess 241. In assembly, the second abutting portions 251 lock with the second recesses 241 for positioning and preventing the second pads 25 from disengagement.

Each second terminal 22 comprises a U-shaped lower contact portion 221, a retaining portion 222 extending from a bottom of the lower contact portion 221 and bending to be generally parallel to the lower contact portion 221, and a second soldering portion 223 extending outwardly from a bottom of the retaining portion 222. Contact tabs 2211 project from inner surfaces of the lower contact portions 221. In assembly, the second terminal 22 is inserted into the second passageway 211 from below the second insulative housing 21. The lower contact portion 221 is embedded in the second passageway 211, the inner surfaces of the lower contact portion 221 substantially extending into the second passageway 211. The retaining portion 222 is fixed on the through groove 212. The second soldering portion 223 extends beyond a bottom of the second insulative housing 21.

Figure 7:
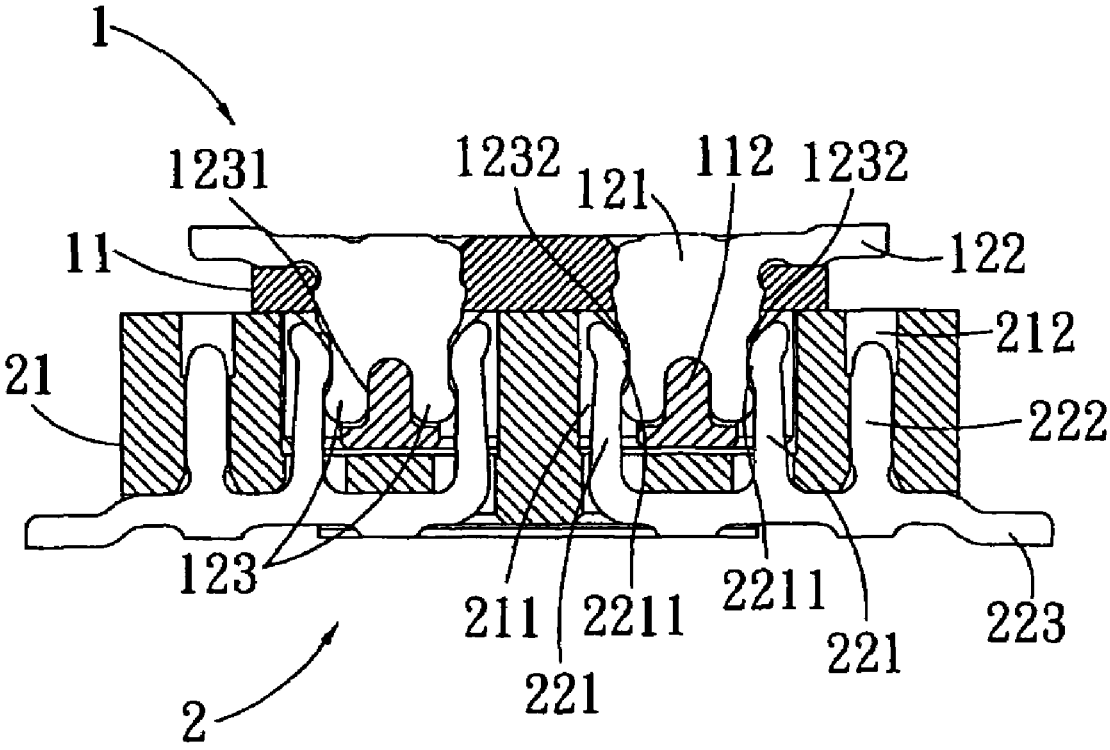
FIG. 7 is a cross-sectional view of the first connector of FIG. 2 being assembled to the second connector of FIG. 6.

Finally referring to FIG. 7, when the first connector 1 mates with the second connector 2, the first connector 1 is put upside down and is plugged onto the second connector 2. The upper contact portions 123 contact the lower contact portions 221 to form electrical connection. The contact tabs 2211 of the lower contact portions 221 bias against the contact grooves 1232 of the upper contact portions 123, forcing the lower contact portions 221 to contact the upper contact portions 123 firmly, thereby assuring smooth and stable electrical transmission.

When the first terminals 12 are assembled in the first passageways 111, the positioning portions 112 of the first insulative housing 11 position the second terminals 12. Moreover, the positioning portions 112 latch with the concave portions 1231 of the upper contact portions 123, further retaining the first terminals 12. In addition, structures of the first terminals 12 and the second terminals 22 improve reliability of engagement between the first connector 1 and the second connector 2, further enhancing retention and ensuring stable transmission.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A board-to-board connector comprising:

a first insulative housing having an intermediate portion extending longitudinally between a pair of opposed side walls, a plurality of first passageways being defined in the intermediate portion arrayed in at least two rows opposing each other, positioning portions being formed on the first insulative housing and respectively protruding into the first passageways; and a plurality of first terminals, each including a base positioned in the first passageway of the first insulative housing, a first soldering portion extending outwardly from a bottom of a side of the base and extending out of the first passageway, and a bifurcate upper contact portion extending upwardly from the base and being inserted in the first passageway, the upper contact portion having two contact sections defining a symmetrically configured pair of opposed contact surfaces projecting laterally outward from one of the first passageways, a concave portion being defined between the two contact sections for corresponding to the positioning portion;

wherein first rails are formed along parallel upper and lower edges of each of the opposed side walls of the first insulative housing, a first recess being defined in each of the opposed side walls of the first insulative housing to extend transversely between the first rails thereof;

wherein first pads are slidable along the first mils, each first pad forming a first abutting portion for corresponding to the first recess to be positioned.

2. The board-to-board connector as recited in claim 1, wherein contact grooves are respectively defined in outward sides of each upper contact portion.

3. A board-to-board connector comprising:

a first connector comprising:

a first insulative housing having an intermediate portion extending longitudinally between a pair of opposed side walls, a plurality of first passageways being defined in the intermediate portion arrayed in at least two rows opposing each other, positioning portions being formed on the first insulative housing and respectively protruding into the first passageways; and a plurality of first terminals, each including a base positioned in the first passageway of the first insulative housing, a first soldering portion extending from the base, and a bifurcate upper contact portion extending upwardly from the base, the upper contact portion having two contact sections defining a symmetrically configured pair of opposed contact surfaces projecting laterally outward from one of the first passageways, a concave portion being defined between the two contact sections for corresponding to the positioning portion; and a second connector matable with the first connector, comprising:

a second insulative housing having an intermediate portion extending longitudinally between a pair of opposed side walls, a plurality of second passageways arrayed in at least two rows opposing each other, through grooves being defined in the second insulative housing and being arrayed at outward sides of the second passageways; and a plurality of second terminals, each including a U-shaped lower contact portion embedded in the second passageway, the lower contact portion defining a symmetrically configured pair of opposed lower contact surfaces projecting laterally outward from one of the second passageways, the lower contact surfaces engaging respective contact surfaces defined by the upper contact portion of one first terminal to capture said upper contact portion in resiliently biased manner therebetween, a retaining portion offset from the lower contact portion, and a second soldering portion extending from the retaining portion, inner surfaces of the lower contact portion substantially extending into the second passageway, the upper contact portion of the first terminal electrically connecting with the lower contact portion of the second terminal when the first terminal and the second terminal are assembled together;

wherein second rails are formed along parallel upper and lower edges of each of the opposed side walls of the second insulative housing, a second recess being defined in each of the opposed side walls of the second insulative housing to extend transversely between the second rails thereof.

4. The board-to-board connector as recited in claim 3, wherein second pads are slidable along the second rails, each second pad forming a second abutting portion for corresponding to the second recess to be positioned.

5. The board-to-board connector as recited in claim 3, wherein the retaining portion of each second terminal is fixed on the through groove of the second insulative housing.

6. The board-to-board connector as recited in claim 3, wherein contact tabs project from inner surfaces of the lower contact portions.

* * * * *